US005765775A

United States Patent [19]

Keserica

[11] Patent Number: 5,765,775

[45] Date of Patent: Jun. 16, 1998

[54] PAPER ROLL HOLDER WITH PIVOTABLE CROSS BAR FOR LOADING AND REMOVAL OF PAPER ROLL

[76] Inventor: Eugene Keserica, 102 Eastwood Dr., Taylors, S.C. 29687

[21] Appl. No.: 932,558

[22] Filed: Sep. 19, 1997

Related U.S. Application Data

[63] Continuation of Ser. No. 634,151, Apr. 18, 1996, abandoned.

[51] Int. Cl.[6] ..... B65H 18/04; B65H 49/26; B65H 75/18

[52] U.S. Cl. ..... 242/597.5; 242/597

[58] Field of Search ..... 242/597, 597.1, 242/597.2, 597.5, 597.8, 598.2

[56] References Cited

U.S. PATENT DOCUMENTS

| | | | |
|---|---|---|---|
| D. 267,760 | 2/1983 | Vrignaud . | |
| D. 304,402 | 11/1989 | Van Hoose . | |
| 873,188 | 12/1907 | Thumann . | |
| 1,069,757 | 8/1913 | Bens et al. | 242/598.2 |
| 1,156,266 | 10/1915 | Bens et al. | 242/598.2 X |
| 1,665,738 | 4/1928 | Hoegger | 242/598.2 |
| 2,240,629 | 5/1941 | Smith | 242/592 |
| 2,248,482 | 7/1941 | Shearer | 242/597 X |
| 2,466,957 | 4/1949 | Lewis | 242/598.1 |
| 2,661,165 | 12/1953 | Salmonson . | |
| 2,681,187 | 6/1954 | Zettelmeyer | 242/597.1 |
| 4,416,425 | 11/1983 | Kish | 242/598.1 |
| 4,824,038 | 4/1989 | Chandler | 242/598.2 |

*Primary Examiner*—Daniel P. Stodola
*Assistant Examiner*—Gregory J. Strimbu
*Attorney, Agent, or Firm*—Hardaway Law Firm P.A.

[57] ABSTRACT

A paper roll holder having both a first and a second support mounted to a back wall. A cross bar is pivotally mounted on the first support to allow a paper roll to be inserted on the cross bar when the cross bar is pivoted away from the second support. During normal operation, the cross bar rests on the second support. A spent paper roll can be removed by merely pulling on the roll core so that the cross bar breaks contact with the second support allowing the roll core to slide off the end of the cross bar.

8 Claims, 3 Drawing Sheets

PAPER ROLL HOLDER WITH PIVOTABLE CROSS BAR FOR LOADING AND REMOVAL OF PAPER ROLL

This application is a file wrapper continuation of application Ser. No. 08/634,151, filed Apr. 18, 1996, now abandoned.

RELATED APPLICATIONS

This application is related to my U.S. Design Pat. Application entitled PAPER ROLL HOLDER, Ser. No. 29/052,955, filed on Apr. 16, 1996, the same day as this application.

BACKGROUND OF THE INVENTION

This invention is directed to the art of paper roll holders. By "paper roll", Applicant means any article in which a continuous web of paper is rolled around a hollow tube (known as a core), including, but not limited to rolls of paper towel or toilet tissue.

DESCRIPTION OF THE PRIOR ART

Conventional prior art paper roll holders pose various problems. For example, it is typical that to replace the paper roll, the user must squeeze the ends of the rod on which the roll is placed to remove the ends from wells in the paper roll supports. Thereby the rod may be removed and the roll changed. For younger and older users, this can pose a physical problem. Furthermore, this is a time consuming process and, at times, the user may drop the rod, thereby soiling it. Accordingly, people have tried to develop paper roll holders in which the ends of a rod need not be squeezed.

For example, U.S. Pat. No. 873,188 to Thumann, discloses a paper roll holder in which the roll can be merely slid onto a rod. However, in Thumann, to replace the roll, the user must actually touch Thumann's pivoting rod and that may be, in some instances, unsanitary. Furthermore, all the weight of the paper roll is placed on Thumann's single supporting arm, thereby requiring it to be very strong and more costly to manufacture.

U.S. Pat. No. 2,240,629 to Smith, again places all the weight of the roll on the side portion of his yoke. Additionally, Smith's upwardly turned arm is an obstruction to roll placement and may damage the roll as it rotates, e.g., by the outer portions of the roll scraping against the arm. Finally, roll replacement requires the simultaneous lifting of the yoke and the placement of the roll thereon.

U.S. Pat. No. 2,661,165 to Salmonson faces similar problems to Thumann and Smith. In particular, there is rubbing between the paper roll and the holder which may result in damage to the roll or quick tearing of the sheets from the roll.

Finally, there are U.S. Pat. Nos. Des. 267,760, to Vrignaud, and Des. 304,402 to Van Hoose. Neither of these patents solve the problems referred to above; especially Van Hoose, who appears to require the removal of an end cap for roll replacement.

Accordingly, there is room for improvement within the art.

OBJECTS OF THE INVENTION

It is an object of the invention to provide an aesthetically pleasing paper roll holder.

It is a further object of the invention to provide a paper roll holder that allows for the easy replacement of paper rolls.

It is yet a further object of the invention to provide a paper roll holder that does not require the squeezing of the rod ends as in conventional paper roll holders.

It is still yet a further object of the invention to provide a paper roll holder in which the roll supporting cross bar is supported on both ends.

It is still yet a further object of the invention to provide a paper roll holder in which the roll may be replaced without touching anything but the roll to be discarded.

It is still yet a further object of the invention to provide a paper roll holder in which the ends of the roll do not come into contact and rub against parts of the roll holder.

These and other objects of the invention are achieved by a paper roll holder, comprising: a first support, the first support mounted to a back wall; a cross bar, the cross bar mounted to the first support at a point spaced a distance from the back wall substantially equal to at least the depth of the paper roll to be held, the cross bar and the first support constructed to allow the cross bar to pivot; a second fixed support, the second support mounted to the back wall; whereby in a second position the pivotable cross bar is pivoted away from the second fixed support for the loading of the paper roll on the pivotable cross bar and in a first position the pivotable cross bar has at least a portion thereof in contact with the second fixed support to support the paper roll.

Furthermore, these and the other objects of the invention are achieved by a paper roll holder in which the cross bar and the first support are constructed to allow the cross bar to pivot by: rotatably mounting the first support to the back wall; and mounting the cross bar to the rotatable first support.

Yet further, these and the other objects of the invention are achieved by a paper roll holder in which the cross bar and the first support are constructed to allow the cross bar to pivot by: fixedly and non-rotatably mounting the first support to the back wall; and pivotally mounting the cross bar to the first fixed and non-rotatable support.

DETAILED DESCRIPTION OF THE DRAWINGS

With reference to the above figures, a paper roll holder that meets and achieves the various objects of the invention set forth above will now be described.

Figure 1:
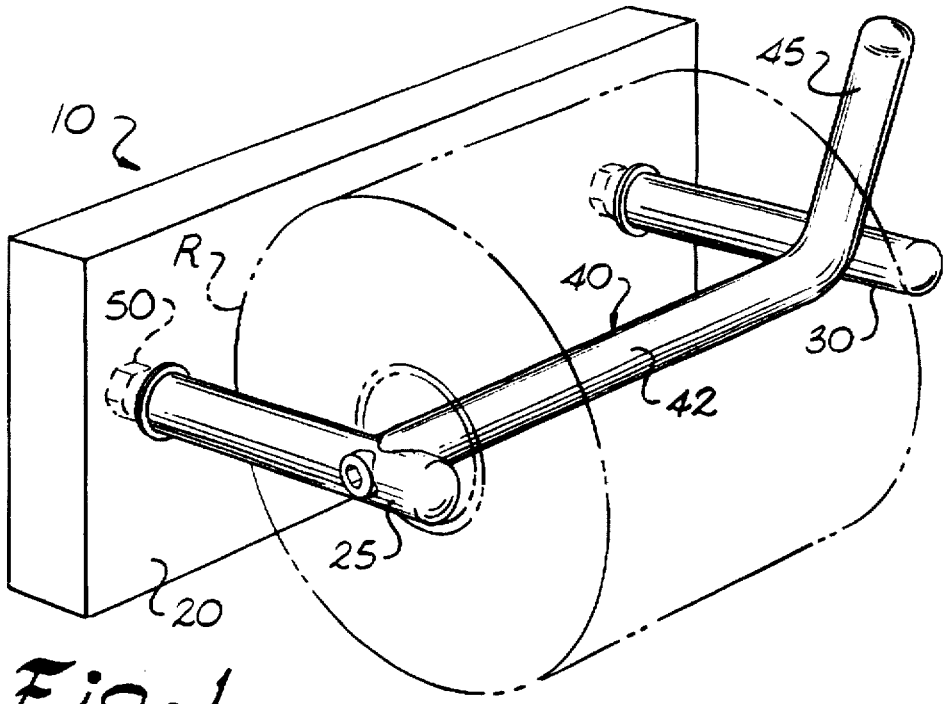
FIG. 1 is a perspective view of a paper roll holder according to the invention in its first configuration.
Figure 4:
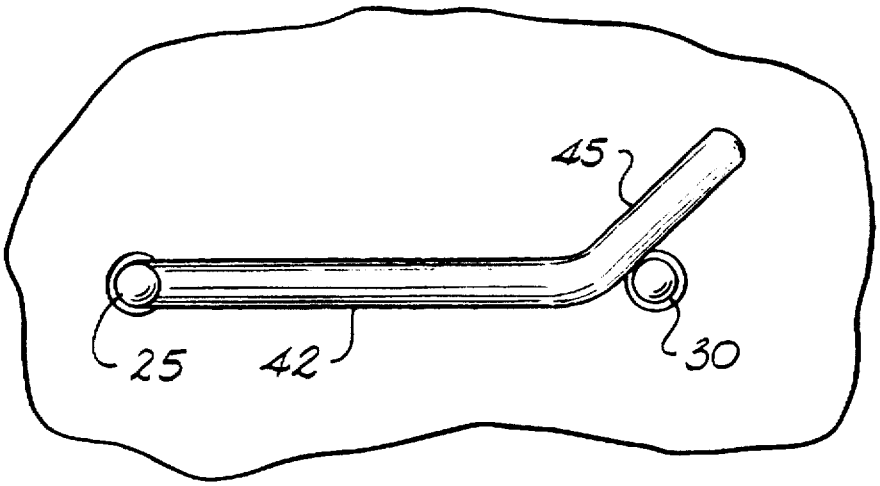
FIG. 4 is a plan view of an alternative embodiment of a paper roll holder according to the invention.

FIG. 1 shows a preferred first embodiment of a paper roll holder 10 according to the invention and supporting paper roll R thereon. Paper roll holder 10 comprises first rotatable support 25 and second fixed support 30 spaced apart by a distance greater than the length of paper roll R. Supports 25 and 30 may have any cross-sectional shape, e.g. circular, hexagonal, oval, triangular, etc. These two supports can be made of polished stainless steel, but any material is generally acceptable. Typically, first rotatable support 25 and second fixed support 30 will be fixed by fasteners 50 to a planar decorative member 20 to be hung on a back wall, via hanger holes 65. Supports 25, 30 extend out from member 20 by an amount substantially equal to, at least, the depth (diameter) of a full paper roll. By "wall", Applicant means any supporting surfaces including but not limited to cabinet walls or the actual walls of the room in which paper roll holder 10 is to be hung. Decorative member 20 can be made from any number of aesthetically pleasing materials such as, but not limited to, stained wood or simulated or real marble. It is further possible to directly fix first rotatable support member 25 and second fixed support member 30 directly to a back wall as that term is broadly defined above (FIG. 4). Furthermore, in normal usage, because walls are typically vertical, first rotatable support member 25 and second fixed support member 30 will typically be horizontal. However, it is conceivable that, for example, the cabinet walls may be at an angle and therefore first rotatable support member 25 and second fixed support member 30 will not be horizontal. This does not affect the operation of paper roll holder 10.

Pivotable cross bar 40 is fixedly mounted at one end to first rotatable support 25. Cross-bar 40 may also have any cross-sectional shape, e.g. circular, hexagonal, oval, triangular, etc. Cross bar 40 comprises a first portion 42 and a second portion 45, angled upward with respect to first portion 42. The angle at which these two portions meet can be varied. First portion 40 will at least be longer than paper roll R.

Figure 2:
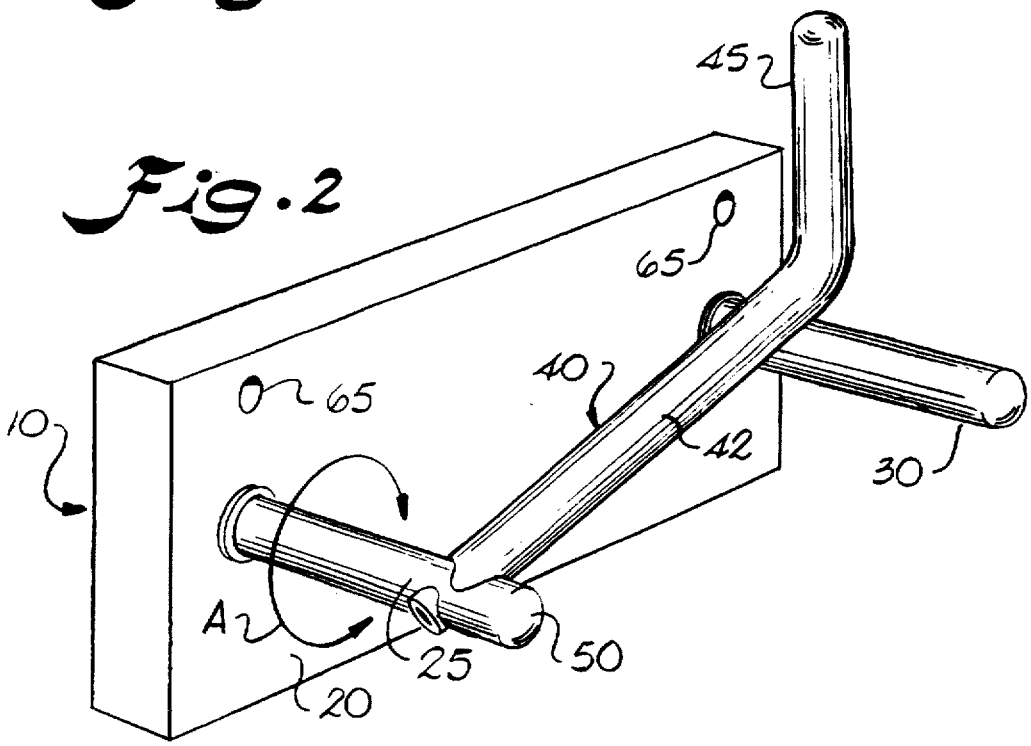
FIG. 2 is a perspective view of a paper roll holder according to the invention in its second configuration.
Figure 3:
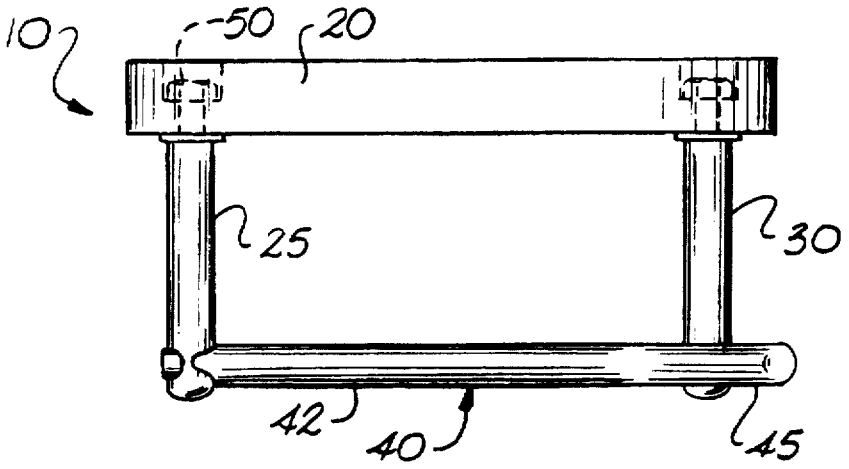
FIG. 3 is a plan view of a paper roll holder according to the invention.

As stated above, pivotable cross bar 40 is fixedly mounted to first rotatable support 25 of paper roll holder 10 and, therefore, can pivot with respect to holder 10 (arrow A of FIG. Two). In FIG. 1, cross bar 40 is in its first position. Here, first portion 42 is horizontal and supporting paper roll R. As for second portion 45, it rests on top of second fixed support 30 that extends out from planar member 20. Therefore, cross bar 40 is supported at both its ends creating an easier to manufacture roll holder because neither support needs to be stronger than the other. Furthermore, as shown in FIG. 1, cross bar 40 is sufficiently long and upward angled portion 45 is angled away from roll R to ensure that the ends of paper roll R do not come into contact with any portion of paper roll holder 10 when roll R is in its normal position equidistant between first rotatable support 25 and second fixed support member 30. Therefore, there is no rubbing problem as found in some of the prior art cited above. FIG. 2 shows cross bar 40 in its second position. Here, cross bar 40 is pivoted away from second fixed support 30 so that it may have a paper roll placed thereon.

With this structure, roll replacement becomes very simple. All one need do is grasp the remaining empty roll core and lift it. This results in the lifting of cross bar 40 away from second fixed support 30. Then, the core is removed and discarded, a new one put in its place, and the roll lowered. As can be seen from this description, the user never needs to touch anything other than the roll, creating a more sanitary and easy to use paper roll holder not contemplated by the prior art.

Figure 5:
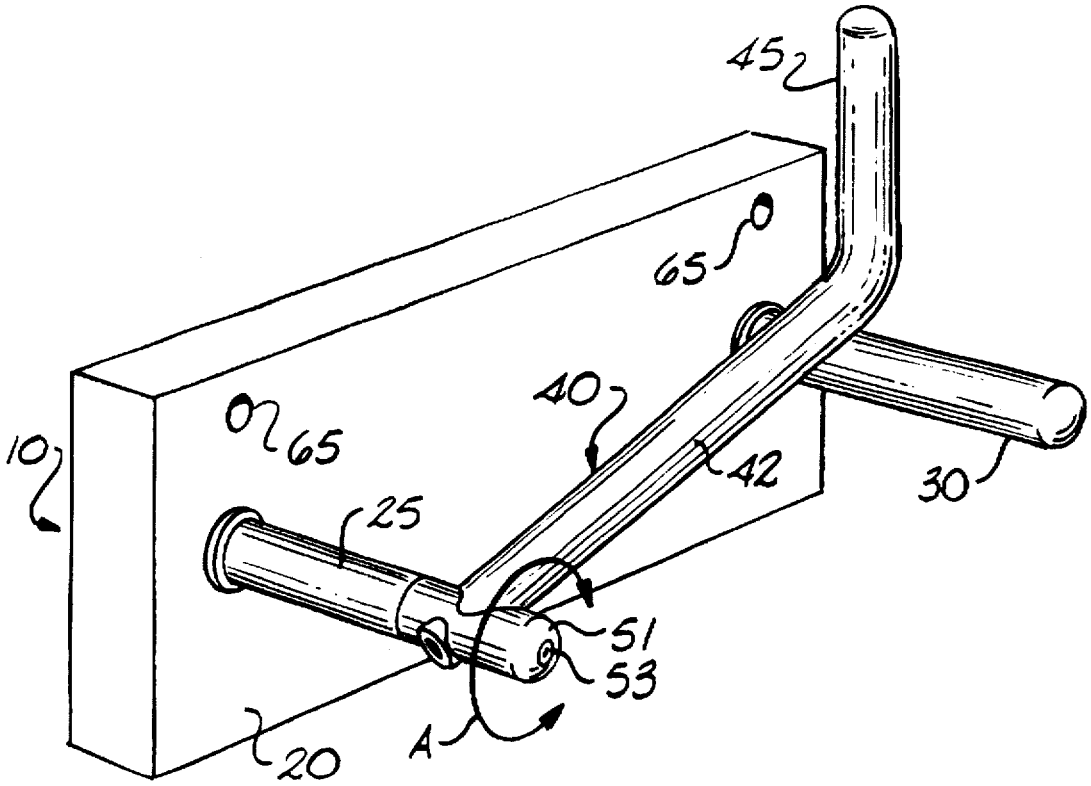
FIG. 5 is a perspective view of yet another embodiment of a paper roll holder according to the invention.

It is possible to pivotally mount cross bar 40 to planar member 20 in many different ways. For example, as shown in the embodiment of FIG. 5, both supports 25, 30 can be fixedly and non-rotatably mounted to planar member 20 using fasteners 50. Then, in any number of conventional and well known ways, such as by use of end piece 51 and fastener 53 or direct mounting, one end of cross bar 40 could be pivotally mounted to the end of either of fixed supports 25, 30 with the angled portion 45 resting on the other of fixed supports 25, 30.

The above description is given in reference to a paper roll holder. However, it is understood that many variations are apparent to one of ordinary skill in the art from a reading of the above specification and such variations are within the spirit and scope of the instant invention as defined by the following appended claims.

That which is claimed:

1. A paper roll holder, comprising:

a first support, said first support mounted to a back wall;

a cross bar, said cross bar mounted to said first support at a point spaced a distance from said back wall, said distance being substantially equal to at least a depth of a paper roll comprising a roll core and paper, said depth being the radial distance from the center of said roll core to the outer periphery of said paper, said cross bar and said first support constructed to allow said cross bar to pivot in a plane substantially parallel to said back wall;

a second fixed support mounted to said back wall;

whereby in a second position, said pivotable cross bar is pivoted away from said second fixed support for loading of said paper roll on said pivotable cross bar and in a first position, said pivotable cross bar has a horizontal portion supporting said paper roll and a portion angled upwardly with respect to an axis of said horizontal portion, wherein said upwardly angled portion rests on an upper surface portion of said second fixed support; and whereby said roll core can be removed when said paper is depleted by grasping said roll core and pulling so that said cross bar breaks contact with said second fixed support.

2. The paper roll holder according to claim 1 wherein said paper roll is supported in a substantially horizontal configuration.

3. The paper roll holder according to claim 1, wherein said back wall is a vertical planar member.

4. The paper roll holder according to claim 3, wherein said vertical planar member is a decorative member integral with said paper roll holder and hung on another back wall.

5. The paper roll holder according to claim 1, wherein said cross bar and said first support are constructed to allow said cross bar to pivot by:

rotatably mounting said first support to said back wall; and mounting said cross bar to said rotatable first support.

6. The paper roll holder according to claim 1, wherein said cross bar and said first support are constructed to allow said cross bar to pivot by:

fixedly and non-rotatably mounting said first support to said back wall; and pivotally mounting said cross bar to said first support.

7. The paper roll holder according to claim 1, wherein ends of said paper roll do not contact any portion of said paper roll holder when said paper roll is in a normal operative position.

8. A paper roll holder, consisting of:

a planar member;

a first support mounted to said planar member;

a cross bar connected to said first support, said cross bar and said first support constructed to allow said cross bar to pivot in a plane substantially parallel to said planar member; and a second fixed support mounted to said planar member;

whereby in a second position, said pivotable cross bar is pivoted away from said second fixed support for loading of said paper roll on said cross bar and in a first position, said pivotable cross bar has a horizontal portion for supporting a paper roll and a portion angled upwardly with respect to an axis of said horizontal portion, wherein said upwardly angled portion rests on an upper surface portion of said second fixed support.

* * * * *